United States Patent [19]

Scott, Sr.

[11] Patent Number: 4,692,954

[45] Date of Patent: Sep. 15, 1987

[54] LEGREST AND FOOTREST FOR BEDS

[76] Inventor: Eugene E. Scott, Sr., 4619 Longfellow Dr., New Orleans, La. 70127

[21] Appl. No.: 902,579

[22] Filed: Sep. 2, 1986

[51] Int. Cl.[4] ..... A47C 20/02

[52] U.S. Cl. ..... 5/443; 5/444

[58] Field of Search ..... 5/443, 444, 431, 80, 5/432; 297/438, 439

[56] References Cited

U.S. PATENT DOCUMENTS

| | | | |
|---|---|---|---|
| 998,996 | 7/1911 | Swenson et al. | 5/444 X |
| 1,067,733 | 7/1913 | Hassel | 5/444 |
| 1,399,837 | 12/1921 | Wood | 5/444 |
| 2,140,310 | 12/1938 | Brown et al. | 5/444 X |
| 2,914,116 | 11/1959 | Göhmann | 5/444 X |
| 2,960,151 | 11/1960 | Fairgrieve | 5/443 X |
| 3,086,225 | 4/1963 | Fillingim | 5/444 |
| 3,472,224 | 10/1969 | Ewerwahn | 5/444 X |
| 3,556,591 | 1/1971 | Smith | 5/443 X |
| 3,893,197 | 7/1975 | Ricke | 5/443 |
| 3,967,334 | 7/1976 | Ricke et al. | 5/443 |

FOREIGN PATENT DOCUMENTS

| | | | |
|---|---|---|---|
| 319528 | 3/1920 | Fed. Rep. of Germany | 5/444 |
| 12180 | of 1915 | United Kingdom | 5/444 |

*Primary Examiner*—Gary L. Smith
*Assistant Examiner*—Carl M. DeFranco, Jr.
*Attorney, Agent, or Firm*—George A. Bode

[57] ABSTRACT

A leg and foot rest for beds comprising: a pair of triangular supports, each having a base member with a channel for slidably engaging a side railing of a bed, an angular support member and a vertical support member; a crossbar for interconnecting the triangular supports and for providing a supporting member on which support bars are secured for supporting a footrest; and a legrest having braces on each end which can be attached to the angular support members by engaging projections of the braces within apertures provided in the angular support members.

1 Claim, 4 Drawing Figures

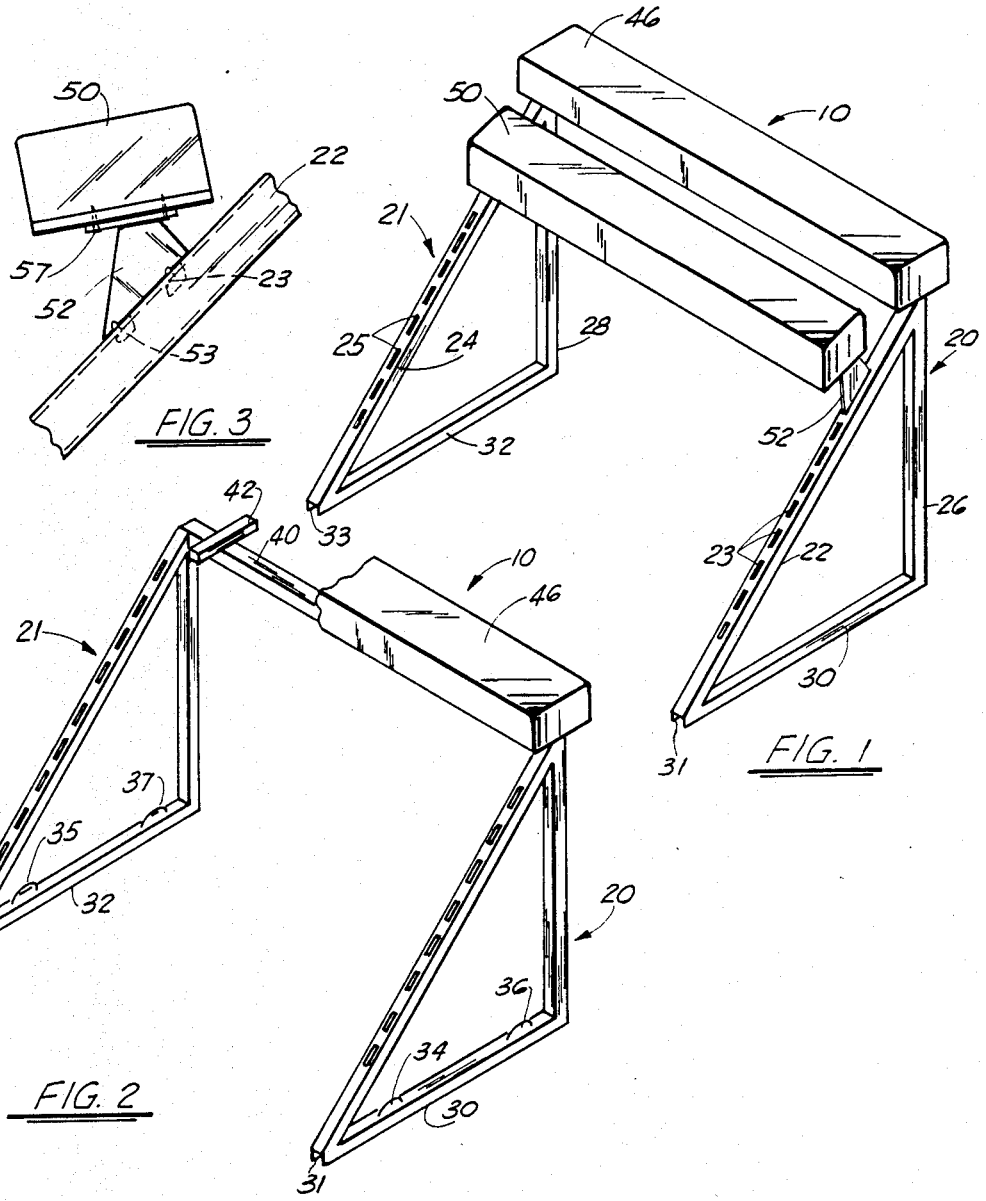
50
22
57
52
23
53
FIG. 3
46
50
10
21
25
24
28
20
52
32
26
42
40
33
10
46
23
22
21
30
31
FIG. 1
37
35
32
33
20
36
34
30
31
FIG. 2
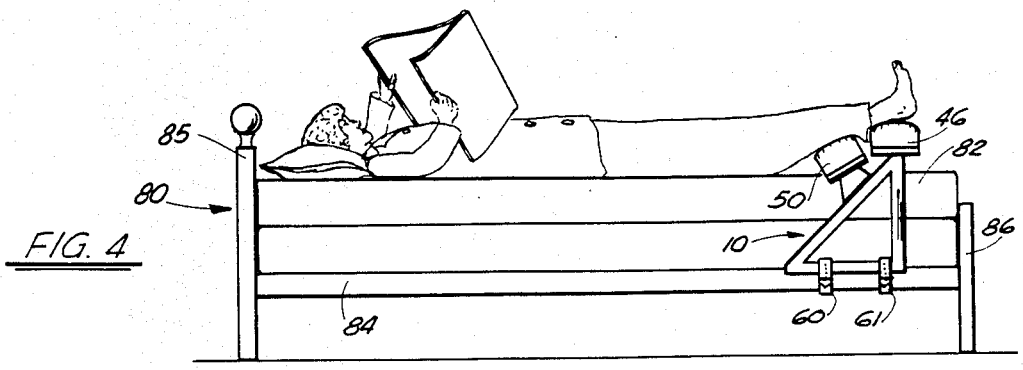
85
80
46
82
50
10
86
84
60
61
FIG. 4

LEGREST AND FOOTREST FOR BEDS

BACKGROUND OF THE INVENTION

1. Field of the Invention

The present invention relates to new and useful improvements in leg and foot rests for beds. The present invention relates, more particularly, to such a device comprising a pair of triangular support means, each having a base member with a channel for engaging a side railing of a bed, and a crossbar for interconnecting the triangular support means and for providing a means on which support bars are mounted for supporting a footrest cushion. A legrest cushion having protrusions on each end can be attached to the angular support member of the triangular support means by engaging the projections in spaced apart apertures provided in the angular member.

2. General Background

Foot and leg rests for beds are frequently cumbersome and difficult to move when a change in their position is necessary. Often because of the weight of the feet and legs, there are problems with stability. Most of these devices are not adaptable to other uses and so, when a legrest, bed table, backrest, or position maintenance device is needed, the bed and surroundings become unusually cluttered with a multiplicity of different devices.

Various attempts have been made to fill the need for such a device. For example:

U.S. Pat. No. 1,399,837 issued to E. L. Wood provides an A-frame supporting structure, the feet of which are attached by screws fitting into clamps mounted on a bed, the footrest having a portion resting flat on the mattress;

U.S. Pat. No. 1,067,733 issued to N. H. Hassel provides an adjustable footrest, comprising a pillow consisting of a wooden core provided with a longitudinally extending central bar in a recess at each end of the wooden core. On each end of the core is placed an eliptically shaped plate secured thereto by means of suitable screws and being provided with an outwardly extending boss. A shaft extends through the central bar of the core and is rotatably mounted in central openings and plates at each end of the core of the pillow. The shaft is provided at each end thereof with a squared portion which extends into a square opening in a supporting arm, there being a supporting arm at each end of the shaft which engages the squared portion of the shaft. The device is mounted by means of a threaded bolt which tightens the clamping plate and clamping bar around the crossbar of a bed;

U.S. Pat. No. 998,996 issued to J. M. Swenson, et al. provides for a footrest supported by a pair of standards secured to the side rails of a bed by a clamp and secured to the footrest by an adjustable screw;

U.S. Pat. No. 1,577,825 issued to A. M. Jenness provides for an adjustable foot rail supported by adjustable columns which are secured to the rails of a bed by clamps and in which the slotted heads of the adjustable columns matingly engage to respective ends of the foot rail;

U.S. Pat. No. 1,247,369 issued to J. E. Butler provides a device for preventing a patient from slipping toward the foot of the bed having a supporting structure secured by clamps to the side rails of a bed, the supporting structures support a plate lying just above the mattress to which a multiplicity of spaced apart bars are secured providing support for the feet;

U.S. Pat. No. 1,539,082 issued to A. M. Fyler provides a device to prevent a patient from slipping toward the foot of the bed having an elongated crosspiece covered with padding which lies flat on the mattress; the crosspiece is supported by brackets which engage the side rails of the bed from below.

Although these patents have attempted to fill this need, until now none has been completely successful in providing a device which is extremely stable, yet easily movable, and which can be easily adapted to other uses, such as a legrest, backrest, table and means for preventing a patient from slipping toward the foot of the bed.

Accordingly, there appears to be a longstanding need for an improved device which will overcome the aforementioned problems.

GENERAL DISCUSSION OF THE PRESENT INVENTION

The present invention relates to new and useful improvements in leg and foot rests for beds. The present invention relates, more particularly, to such an apparatus comprising: a pair of triangular support means, each having a base member with a channel for engaging the side railing of a bed, an angular support member, and vertical support member; and, a crossbar for interconnecting the triangular support means and for providing a supporting means on which a support bar is mounted for supporting a footrest cushion. A legrest cushion having downwardly depending protrusions on each end can be attached to the angular support members by engaging the projection in spaced apart apertures provided in the angular support members. Other attachments having a variety of uses can also be attached in a similar manner.

The present invention has as its primary objective to provide leg and foot rests for beds, which have a high degree of stability and are durable and long lasting.

Another important objective of the present invention is to provide a device which is portable.

Still another important object of the present invention is to provide a device which can serve as both a footrest and legrest at the same time, thereby increasing the comfort of the user.

Yet another important object is to provide a device which can be easily moved to different positions along the rails of the bed or can be secured by means of straps to one position.

Still another important object of the present invention is to provide a device which is easy and inexpensive to manufacture.

Yet another important object of the present invention is to provide a device which is adaptable by attachments to a variety of other important uses. The present invention can be easily adapted by attachments to serve as a bed table, a backrest, to provide side bars for preventing a patient from falling out of bed, or a device for use in hospitals and sick rooms to prevent a patient, when sitting up, from sliding toward the foot of the bed.

Other objects, advantages, and novel features will become apparent from the following detailed description and drawing.

BRIEF DESCRIPTION OF THE DRAWING

For a further understanding of the nature and objects of the present invention, reference should be had to the following detailed description, taken in conjunction with the accompanying drawings, in which like parts are given like reference numerals and, wherein:

FIG. 1 is a perspective view of the invention;

FIG. 2 is a perspective view of the invention without the legrest cushion and with part of the footrest cushion cut away to show a support bar secured to the crossbar;

FIG. 3 is a side view of the legrest, showing the projections engaged (in phantom) by the spaced apart apertures of the angular support member: and FIG. 4 is a side view of the invention mounted on the side railings of a bed and being utilized as a leg and foot rest.

DETAILED DESCRIPTION OF THE PREFERRED EMBODIMENT

Referring to the drawing and, more particularly, to FIG. 1, my leg and foot rest for beds, designated generally by the numeral 10, is shown to have a pair of triangular support means 20 and 21. First triangular support means 20 is constructed by fixedly connecting at the ends thereof first base member 30, first angular support member 22, and first vertical support member 26. Second triangular support means 21, having a second base member 32, second angular support member 24, and second vertical support member 28 is constructed in a similar manner. First and second base members 30, 32 have as undersides U-shaped channels 31, 33 respectively for slidably engaging the side railings 84 of a bed 80, as best seen in FIG. 4. The first and second angular support members 22, 24 have a multiplicity of spaced apart apertures 23, 25 respectively therein for engagement by projections 53, 55 on braces 52, 54 of legrest 50, as best seen in FIG. 3. (Projections 55 and brace 54 would be seen in the view opposite FIG. 3).

As best seen in FIG. 2, first triangular support means 20 is fixedly connected to one end of the crossbar 40 at approximately the point where first angular support member 22 and the first vertical support member 26 meet. The opposite end of the crossbar 40 is fixedly connected at approximately the same corresponding point where second angular support member 24 and second vertical support member 28 meet. These connections may be by welding or any other conventional method providing a strong, fixed interconnection. Crossbar 40 is of approximately the same length as the distance between side railings 84 of bed 80 and serves to hold triangular support means 20, 21 in the proper orientation and at the proper distance in relation to each other for simultaneously engaging channels 31,33 on the respective side railings 84 of bed 80.

As best seen in FIG. 2, a multiplicity (only one is shown) of support bars 42 are fixedly mounted on the top of crossbar 40, such that when leg and foot rest 10 is in proper position on bed 80, as best seen in FIG. 4, support bars 42 are substantially parallel to the surface of mattress 82 and are perpendicular to crossbar 40. Support bars 42 may be welded to crossbar 40, or connected in any other conventional manner which provides a strong, fixed connection.

As best seen in FIGS. 1 and 2, an elongated, padded footrest cushion 46 is provided on support bars 42. Elongated, padded footrest cushion 46 (and legrest cushion 50 to be discussed further herein) has a rigid core (not shown) and foam rubber padding (also not shown) thereon, covered by vinyl, cloth or other suitable material. Elongated padded footrest cushion 46 is secured to support bars 42 by conventional means such as nuts and bolts, screws or adhesives.

As best seen in FIG. 3, elongated, padded legrest cushion 50 can be removably attached to angular support members 22, 24 by means of a first brace 52 and second brace 54 (not shown, but on the opposite side of the view of FIG. 3). Projections 53, 55 on braces 52, 54 are matingly engaged in the spaced apart apertures 23, 25 on angular support members 22, 24 respectively. The position of legrest cushion 50 can be adjusted along angular support members 22, 24 for maximum comfort and convenience. Braces 52, 54 are attached to the rigid core member 57 of cushion 50 by conventional means such as bolts and nuts, screws or the like. The foam rubber padding (not shown) greatly increases comfort.

As best seen in FIG. 2, a multiplicity of tongues 34, 36 and 35, 37 are provided on the upper surface of base members 30, 32 respectively for removably slidably securing, by means of straps 60, 61, the channels 31, 33 of base members 30, 32 on the side rails 84 of bed 80.

My invention can also be adapted for use as a bed table. In this case, a conventional table surface (not shown) is secured to crossmembers (not shown) which are elongated bars, the ends thereof being attached to braces (not shown), have projections which are engaged by the spaced apart apertures 23, 25 in the first and second angular support members 22, 24. My invention can also be used to provide a side railing on bed 80, for example, to prevent a child or sick room patient from falling out of bed 80. In this case, an elongated side rail bar (not shown) is connected to two braces having projections with one engaging spaced apart apertures 23 in the angular support member 22 and the other engaging spaced apart apertures (not shown) in vertical support member 26, thereby supporting the elongated side rail bar (not shown) in a horizontal position parallel to the surface of mattress 82.

My invention can also be adapted for use as a backrest. In this case, legrest 50 and footrest 46 are placed so that the angular support members 22, 24 are facing the foot 86 of bed 80 while vertical support members 26, 28 are facing head 85 of the bed 86. The leg and foot rest is placed close to head 85 of bed 86. An attachment having a backrest cushion (not shown) of length approximately equal to the distance between angular support members 22, 24 and width approximately equal to the length of support members 22, 24, attaches to a multiplicity of braces (not shown) having projections which are engaged by apertures 23, 25 in angular support members 22, 24.

My invention can also be adapted for use as a sick room or hospital patient position maintenance device. In this case, a flat maintenance member is attached to braces having projections which are engaged by either spaced apart apertures 23, 25 of angular support members 22, 24 or by spaced apart apertures (not shown) on vertical support members 26, 28, such that the position maintenance member (not shown) is substantially vertical when in use, with one end resting on mattress 82. This allows the patient when sitting up to be able to place his feet against the position maintenance member to prevent slipping toward to the foot 86 of the bed 80.

Obviously, many modifications and variations of my invention are possible in light of the above teachings; further, since many modifications and variations will readily occur to those skilled in the art, it is not desired to limit the invention to the exact construction and operation shown and described, and accordingly, all suitable modifications and equivalents may be resorted to, as falling within the scope of the invention as claimed.

What is claimed as invention is:

1. A portable leg and foot rest for beds, comprising:

(a) a pair of triangular support means each having an elongated base member having a channel provided therealong in its underside for slidably engaging the side railings of a bed, a vertical member and an angular member having spaced apart apertures therealong;

(b) a crossbar of a length substantially equal to the distance between said side railings of said bed, each end thereof being fixedly connected to one of said triangular support means at approximately the point where said angular member and said vertical member are joined together, whereby said triangular support means are substantially parallel to each other and substantially perpendicular to said crossbar;

(c) plurality of support bars fixedly connected to said crossbar and being substantially perpendicular to said crossbar and substantially parallel to said base members;

(d) an elongated footrest member of approximately the same length as said crossbar and fixedly mounted on said support bars, said footrest member having an elongated cushion with a solid core member and padding thereon;

(e) a legrest member of approximately the same length as said crossbar and having an elongated cushion with a solid core member and padding, each end of said solid core member fixedly attached to a brace with projections depending downwardly therefrom for selectively and adjustably engaging said spaced apart apertures of said angular support members; and, (f) means for removably fastening said base members to said side railings of said bed.

* * * * *